United States Patent [19]

Kretzschmar et al.

[11] Patent Number: 4,501,133

[45] Date of Patent: Feb. 26, 1985

[54] DUAL NEEDLE ARRANGEMENT

[75] Inventors: Gisela Kretzschmar, Wesseling; Jutta Selter, Altena, both of Fed. Rep. of Germany

[73] Assignee: Gustav Selter, Altena, Fed. Rep. of Germany

[21] Appl. No.: 394,108

[22] Filed: Jul. 1, 1982

[30] Foreign Application Priority Data

Jul. 4, 1981 [DE] Fed. Rep. of Germany ..... 3126451
Nov. 11, 1981 [DE] Fed. Rep. of Germany ... 8132901[U]

[51] Int. Cl.[3] ..... D04B 35/02
[52] U.S. Cl. ..... 66/117
[58] Field of Search ..... 66/116, 117, 118; 223/102, 103, 104

[56] References Cited

U.S. PATENT DOCUMENTS 1,313,461 8/1919 Brown ..... 66/117
2,093,631 9/1937 Burnham ..... 66/117
2,102,600 12/1937 Miller ..... 66/117
2,507,174 5/1950 Phillips ..... 66/117
2,695,506 11/1954 Kohlmann ..... 66/117

*Primary Examiner*—Ronald Feldbaum
*Attorney, Agent, or Firm*—Karl F. Ross; Herbert Dubno

[57] ABSTRACT

A dual needle arrangement has a pair of needles each having a tip and a rear end, a flexible cord connected between the rear ends of the needles, and an eye in the cord between the rear ends. A filament can be laid in by being threaded through the eye and then pulled through the row behind the needle. Both needles can be knitting or crocheting needles. When one is a hook-type crocheting needle and the other is a pointed knitting needle these two needlework styles can be combined to produce a unique type of needlework, and the changeover from one style to the other is easy and not complicated by the inlay filament. The cord can be formed of metal wires, or it can be of a flexible synthetic resin in which case the eye is formed by splicing in the cord. This eye can also be formed by flattening a portion of the cord between the two rear ends and slitting this flattened portion.

7 Claims, 21 Drawing Figures

DUAL NEEDLE ARRANGEMENT

FIELD OF THE INVENTION

The present invention relates to a dual needle arrangement for hand needlework such as knitting and crocheting. More particularly this invention concerns such a needle arrangement which allows a filament to be laid into knit or crocheted work to achieve any of various coloring and patterning effects.

BACKGROUND OF THE INVENTION

A needle is known which is hollow and has an opening at its pointed tip so that as the goods are formed by knitting or crocheting a so-called weft filament passing axially through the needle and extending out through its tip can be inserted or laid into the needlework thus formed. To this end a flexible extension tube may form an elongation of the rear end of the needle to constitute a guide for the filament being inserted. This extension simultaneously serves to hold the chain or row being worked on.

Such a needle arrangement is intended either for knitting or crocheting, with or without an inlay. When these two styles of needlework are mixed it is necessary to switch needles, something that is impossible when there is an inlay filament.

Another disadvantage of the known systems is that they can only be used to lay weft filaments into relatively coarse knits or crochets. In fine knits and in so-called Tunisian crocheting and inlay crocheting the relatively fat inlay needle makes too large a hole. In addition only relatively thin filaments can be laid in, as thick ones cannot be accommodated in the passage through the inlay needle.

OBJECTS OF THE INVENTION

It is therefore an object of the present invention to provide an improved needle arrangement for laying a filament into knitted and/or crocheted good.

Another object is the provision of such a needle arrangement which overcomes the above-given disadvantages.

A further object is to provide an improved inlay needle arrangement which can be used for both knitting and crocheting.

SUMMARY OF THE INVENTION

These objects are attained according to the instant invention in a dual needle arrangement comprising a pair of needles each having a tip and a rear end, a flexible cord connected between the rear ends of the needles, and an eye in the cord between the rear ends.

Thus with the system of this invention a filament can be laid in by being threaded through the eye and then pulled through the row behind the needle. Since the cord can be of much smaller cross section than the needle, it is therefore possible to use a relatively fine needle and to lay in a fine or coarse filament easily. What is more this inlay filament is out of the way of the person doing the needlework, so that this needle arrangement offers several important advantages.

Both needles can be knitting or crocheting needles. According to another feature of this invention, however, one is a hook-type crocheting needle and the other is a pointed knitting needle. In this manner these two needlework styles can be combined to produce a unique type of needlework, and the changeover from one style to the other is easy and not complicated by the inlay filament.

The cord can be formed of metal wires, or it can be of a flexible synthetic resin in which case the eye is formed by splicing in the cord. This eye can also be formed by flattening a portion of the cord between the two rear ends and slitting this flattened portion.

The cord can also be formed according to this invention by a pair of substantially identical and parallel cords extending between the rear ends. These parallel cords can once again be metallic or of a synthetic resin. They are joined together to form the eye. This joining can be accomplished by welding or adhesively jointing the two cords at one location, or by fitting a clamping ring or joining sleeve over the two cords at the center. In this manner actually two eyes are formed, one between the joined location and the rear end of each needle. In use a loop of the filament to be laid in is poked through the eye between the needle being used and the joint and then the assembly is pulled through the row being worked on to lay in this filament.

According to this invention the needles are hollow at least at their rear ends and the cord is received in the hollow rear ends. When the cord is of a synthetic resin the needles can have synthetic-resin coverings that merge at the rear ends with the cord. More specifically a thermoshrinking resin can be used for the covering, so that as it is heated it conforms tightly to the needle and tightly grips the cord. To this end the rear ends taper from the needles to the cord so that a smooth transition is made from the rear end of relatively large diameter to the cord of smaller diameter.

DESCRIPTION OF THE DRAWING

The above and other features and advantages will become more readily apparent from the following, reference being made to the accompanying drawing in which:

FIGS 2*a*–2*i*, show the needle arrangement of FIG. 3 doing inlay crocheting.

SPECIFIC DESCRIPTION

Figure 1:
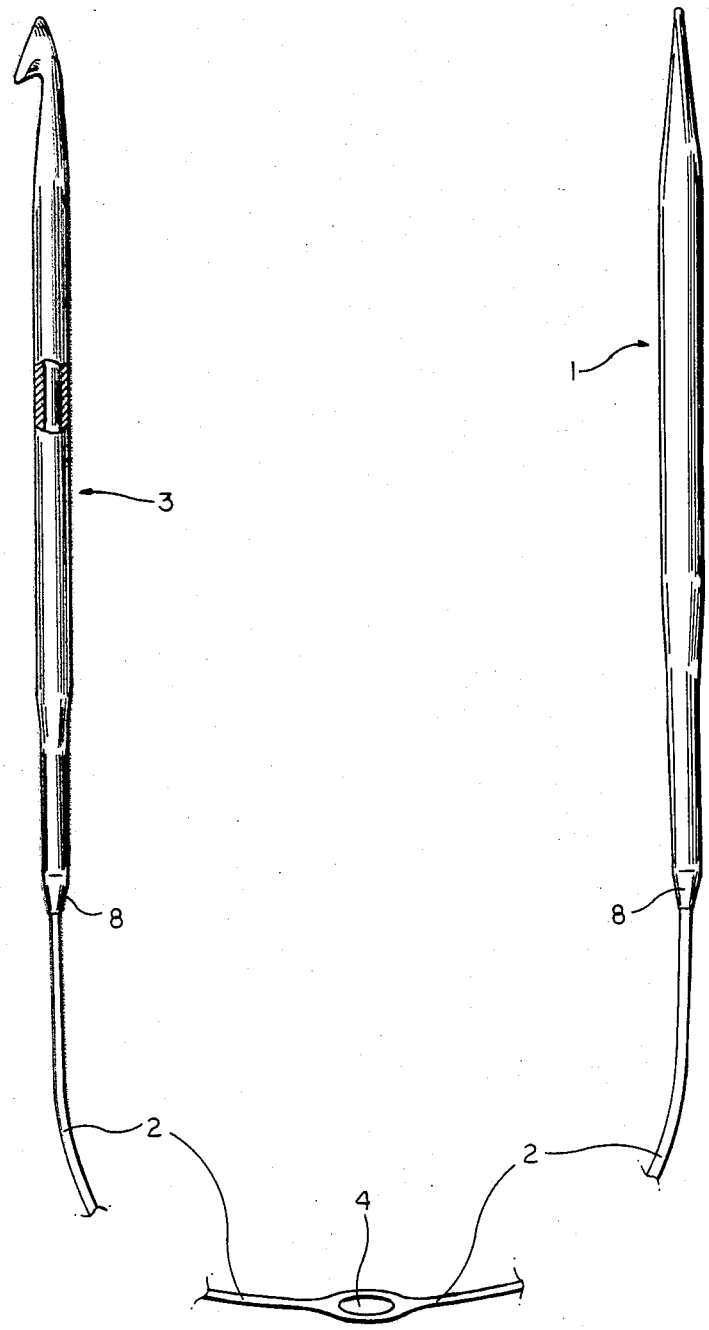
FIG. 1 is a side view of a needle arrangement according to this invention.
Figure 1A:
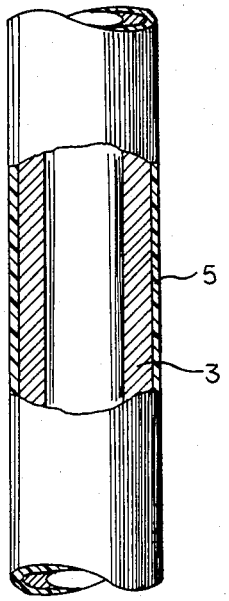
FIG. 1A is a large-scale and partly sectional view of a detail of FIG. 1.
Figure 2A:
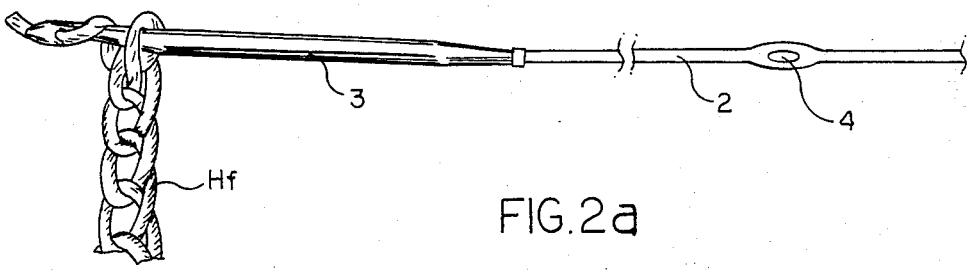
FIGS. 2*a*–2*i* show the needle arrangement of FIG. 1 doing inlay crocheting.
Figure 2B:
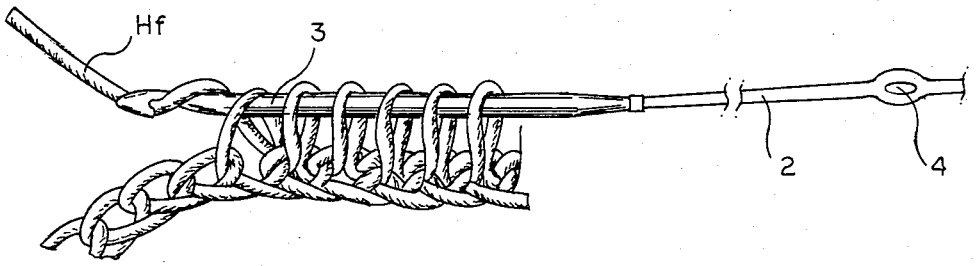
Figure 2C:
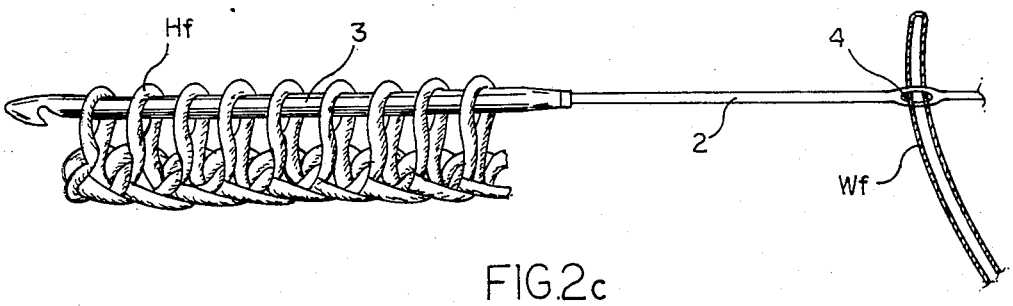
Figure 2D:
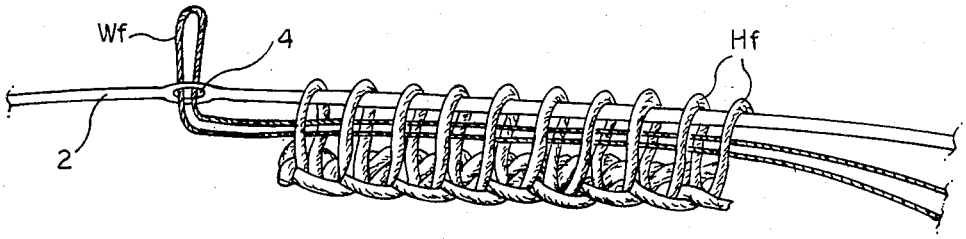
Figure 2E:
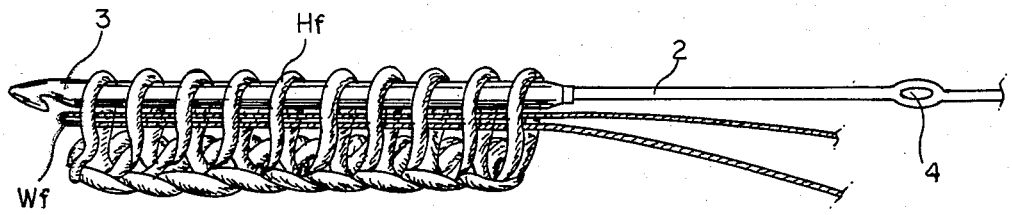
Figure 2F:
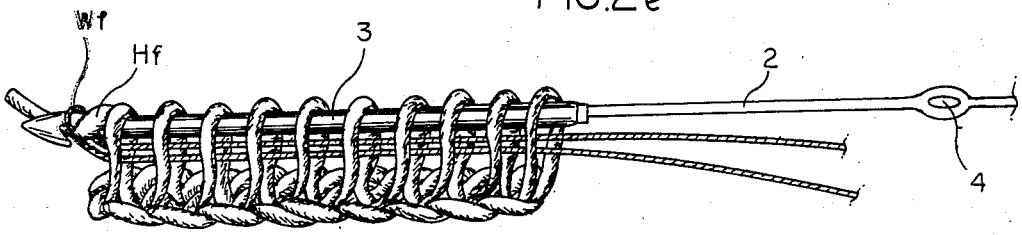
Figure 2G:
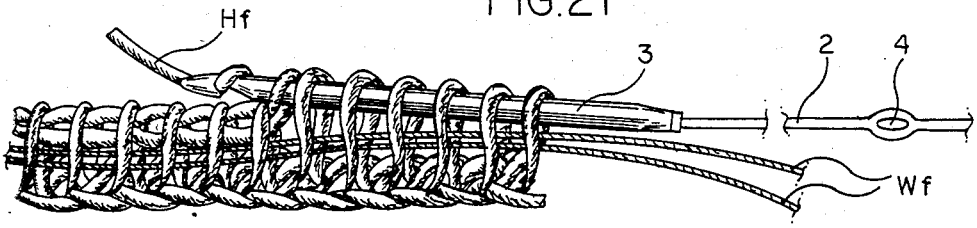
Figure 2H:
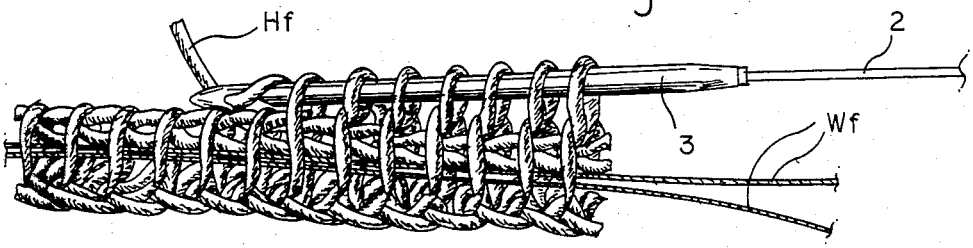
Figure 2I:
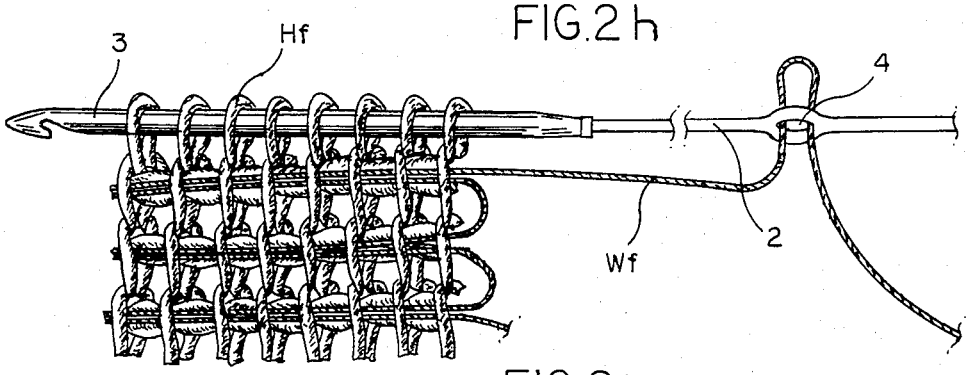

As seen in FIG. 1, a dual needle arrangement according to this invention has a standard knitting needle 1 having a frustoconical backwardly tapered rear end 8 connected via a flexible cord 2 to the similar rear end 8 of a standard hook-type crocheting needle 3. Equidistant between the two rear ends 8 is a transversely throughgoing eye 4. The needles 1 and 3 are, as shown in FIG. 1A, of standard hollow construction, with a synthetic-resin covering 5.

Such a device is made simply by inserting the ends of the cord 2 in the rear ends of the hollow needles 1 and 3 which are otherwise closed. The cord 2 is made of a tough resin, and the covering 6 is made of a resin which shrinks greatly when heated. Unshrunk covers 5 are fitted over the needles 1 and 3 from whose rear ends 8 the cord 2 extends, and then the arrangement is heated to shrink the coverings 5 tight, thereby securing the cord 2 in place. Adhesive may also be applied to the cord ends to hold them in the needles 1 and 3. The eye 4 can be formed in the cord by flattening and slitting it, or by joining two cord pieces at their ends at two spaced locations.

In use as seen in FIGS. *2a* and *2b* the hook needle 3 can relatively easily be used to crochet a row with a filament Hf. Then a loop of an inlay filament Wf is inserted through the eye 4 as shown in FIG. *2b*. This eye 4 is pulled through the row as shown at FIG. *2d* and the loop is pulled out of the eye 4. The needle 3 is then pulled back as seen in FIG. *2e*. This leaves the doubled filament Wf inserted in the goods as the needle 3 forms the back rows (FIGS. *2f* and *2g*) and then goes back in the other direction (FIG. *2h*). The result, as seen in FIG. *2i* where the position is the same as FIG. *2c* but a few rows later, is a piece of crocheted goods with a filament Wf inlaid neatly in place.

Of course it would be possible for differently colored inlay filaments Wf to be pulled only partly through the rows. Alternately inlay filaments can be pulled from the ends only partway through the rows in accordance with a pattern. Novel and attractive effects can be produced with great ease with this system.

Figure 3:
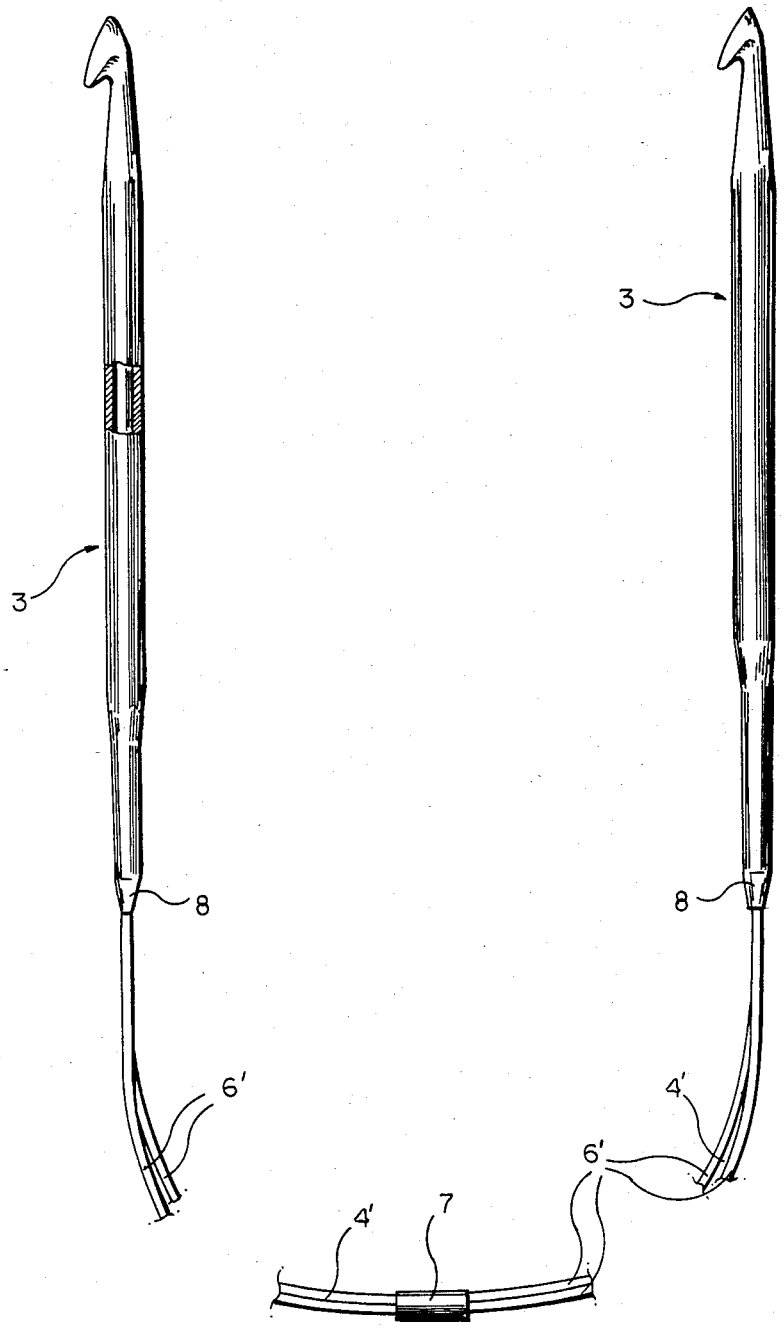
FIG. 3 is a side view of another needle arrangement according to the present invention.
Figure 4A:
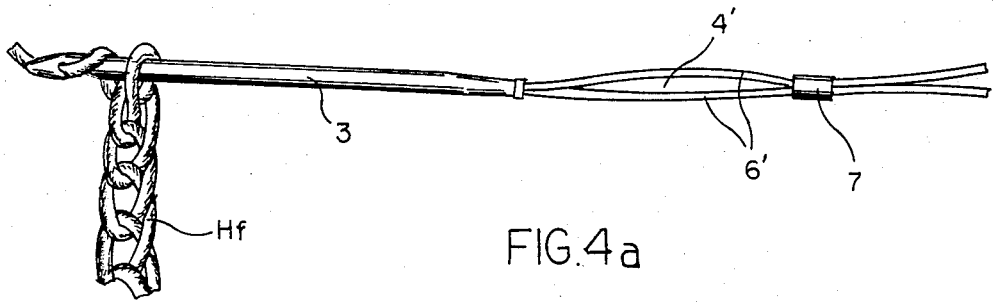
FIGS. 4*a*–4*i*, like respective
Figure 4B:
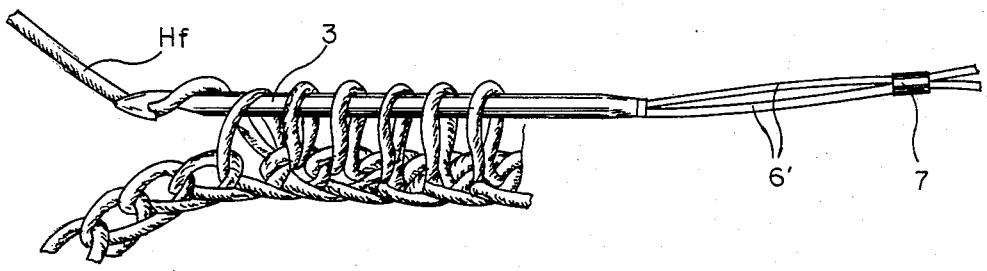
Figure 4C:
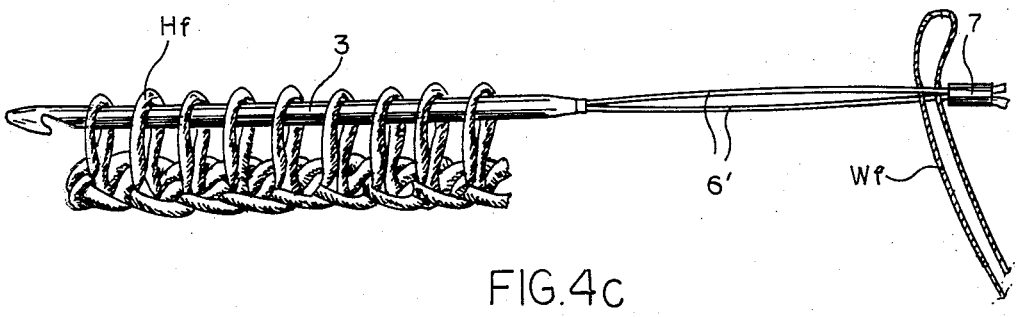
Figure 4D:
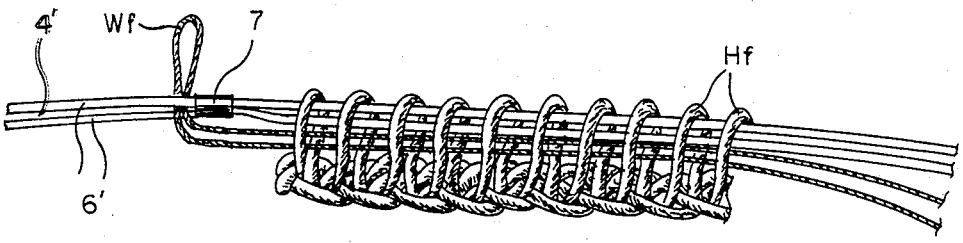
Figure 4E:
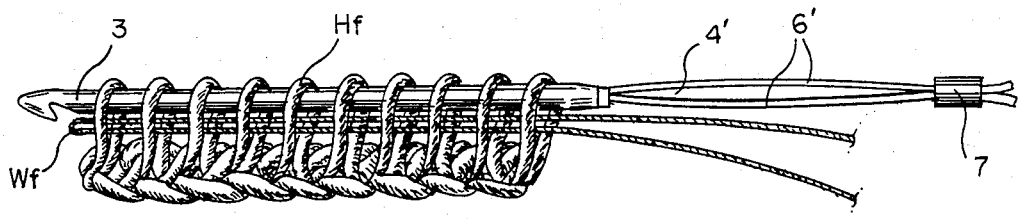
Figure 4F:
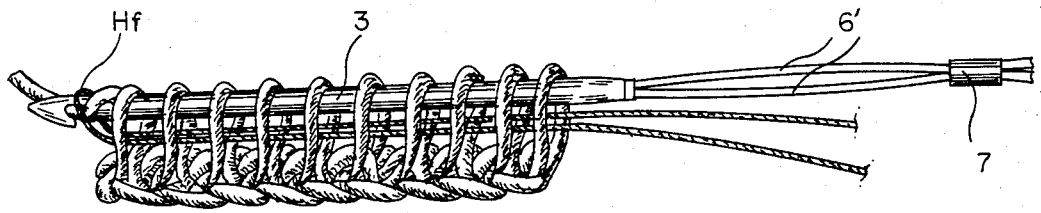
Figure 4G:
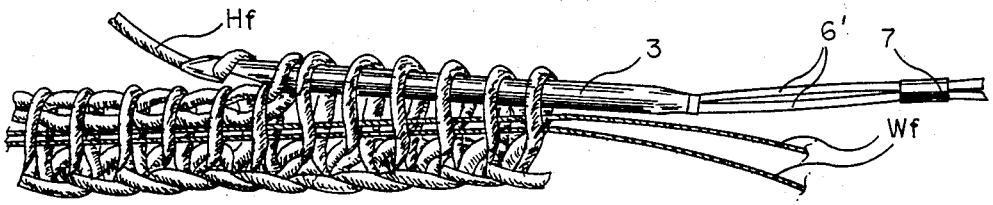
Figure 4H:
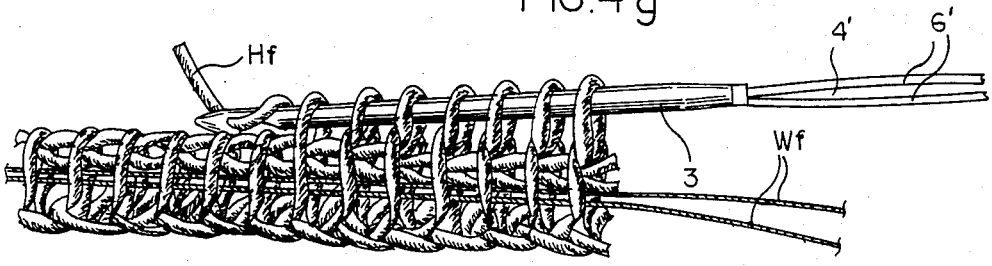
Figure 4I:
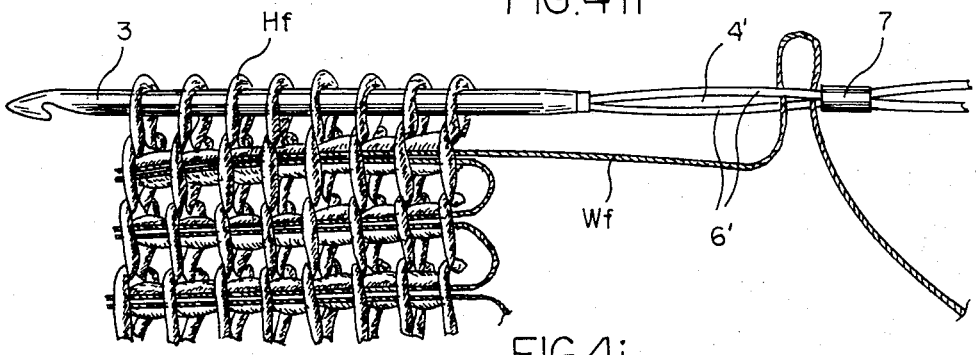

FIG. 3 shows another needle assembly according to this invention, with the same reference characters as FIG. 1 used for identical structure. Here the cord is actually formed by a pair of parallel cords 6' extending between two needles 3. These cords 6' are of metal, a plastic-coated multifilament cable being preferred. They are clipped together at 7 to form two elongated eyes 4' extending from the respective rear ends 8 to the juncture 7. This joined location 7 is formed simply by gripping a ring tightly around the two cords 6'. A shrink collar could also be used and/or the two cords 6' could be soldered or adhesively connected together.

FIGS. *4a–4i* show the needle arrangement of FIG. 3 in the same stages of inlay crocheting as respective FIGS. *2a–2*.

The system according to the instant invention works identically for knitting, except of course that two needles are employed. In addition the presence of the crocheting needle on the other end is often a blessing in knitting when resolving a dropped stitch or the like. What is more the ease of inlaying with this assembly during knitting allows a false argyle to be made with ease, avoiding the necessity of numerous small yarn bobbins and producing a false argyle that can pass for a real one.

We claim:

1. A knitting and crocheting needle arrangement comprising:

a knitting needle having a tip and a rear end;

a hook-type crocheting needle also having a tip and a rear end;

a flexible cord connected between said rear ends of said needles; and an eye in said cord generally midway between said rear ends and dimensioned and positioned such that a filament threaded through said eye can be laid into goods crocheted or knitted by said arrangement.

2. The needle arrangement defined in claim 1 wherein said cord is of a flexible synthetic resin and said eye is formed by splicing in said cord.

3. The needle arrangement defined in claim 1 wherein said cord is of a flexible synthetic resin and is flattened and slit to form said eye.

4. The needle arrangement defined in claim 1 wherein said cord is formed by a pair of substantially identical and parallel cords extending between said rear ends, said cords being joined together to form said eye.

5. The needle arrangement defined in claim 1 wherein said needles are hollow at least at their rear ends, said cord being received in the hollow rear ends.

6. A knitting and crocheting needle arrangement comprising:

a knitting needle having a tip and a rear end;

a hook-type crocheting needle also having a tip and a rear end, said needles being hollow at least at said rear ends;

a flexible synthetic-resin cord connected between and received in said rear ends of said needles;

respective synthetic-resin coverings on said needles that merge at said rear ends with said cord; and an eye in said cord generally midway between said rear ends and dimensioned and positioned such that a filament threaded through said eye can be laid into goods crocheted or knitted by said arrangement.

7. The needle arrangement defined in claim 6 wherein said rear ends taper from said needles to said cord.

* * * * *